US005572892A

United States Patent [19]

Muraki et al.

[11] Patent Number: 5,572,892

[45] Date of Patent: *Nov. 12, 1996

[54] METHOD OF PRODUCING SILICON STEEL HOT ROLLED SHEETS HAVING EXCELLENT SURFACE PROPERTIES

[75] Inventors: Mineo Muraki; Toshito Takamiya; Satoshi Koseki, all of Chiba, Japan

[73] Assignee: Kawasaki Steel Corporation, Japan

[ * ] Notice: The term of this patent shall not extend beyond the expiration date of Pat. No. 5,296,050.

[21] Appl. No.: 295,621

[22] PCT Filed: Dec. 27, 1993

[86] PCT No.: PCT/JP93/01901

§ 371 Date: Aug. 25, 1994

§ 102(e) Date: Aug. 25, 1994

[87] PCT Pub. No.: WO94/14549

PCT Pub. Date: Jul. 7, 1994

[30] Foreign Application Priority Data

Dec. 28, 1992 [JP] Japan ..... 4-348646

[51] Int. Cl.[6] ..... B21B 1/26

[52] U.S. Cl. ..... 72/39; 72/200; 72/365.2; 148/111; 148/504

[58] Field of Search ..... 72/39, 40, 200, 72/202, 234, 365.2, 366.2; 148/110, 111, 112, 504

[56] References Cited

U.S. PATENT DOCUMENTS

| | | | |
|---|---|---|---|
| 4,231,818 | 11/1980 | Henke | 148/111 |
| 5,129,965 | 7/1992 | Kobayashi et al. | 148/113 |
| 5,296,050 | 3/1994 | Takamiya et al. | 148/111 |

FOREIGN PATENT DOCUMENTS

| | | |
|---|---|---|
| 61-96032 | 5/1986 | Japan . |
| 2-138418 | 5/1990 | Japan . |
| 3-115525 | 5/1991 | Japan . |

*Primary Examiner*—Lowell A. Larson
*Assistant Examiner*—Thomas C. Schoeffler
*Attorney, Agent, or Firm*—Austin R. Miller

[57] ABSTRACT

In a production method for silicon steel hot rolled sheets by subjecting a slab of silicon steel to a rough hot rolling through high-temperature heating and then subjecting to a finish hot rolling, rolling at the first stand in the finish hot rolling is carried out so that a relation of thickness at entrance side of the stand $t_{F1}$ (mm), thickness at delivery side thereof $t_{F2}$ (mm), surface temperature of steel sheet at gripping $T_{F0}$ (° C.) and temperature at the depth of $(t_{F1}-t_{F2})/2$ (mm) from the surface of the steel sheet at gripping $T_{F1}$ satisfies the following equation:

$$(T_{F1}-T_{F0})/\{(t_{F1}-t_{F2})/2\} \leqq 10+t_{F1}/10 \text{ (°C./mm)}.$$

Thus, surface defect and surface cracks can be prevented in the hot rolling to provide silicon steel sheets having excellent surface properties.

11 Claims, 4 Drawing Sheets

METHOD OF PRODUCING SILICON STEEL HOT ROLLED SHEETS HAVING EXCELLENT SURFACE PROPERTIES

TECHNICAL FIELD

This invention relates to a method of producing silicon steel hot rolled sheets, and more particularly to a method of producing silicon steel hot rolled sheets having excellent surface properties.

BACKGROUND ART

Grain-oriented magnetic steel sheets are used as a material for iron core in transformers and other electrical machinery and apparatus and required to have a high magnetic flux density and a low iron loss. These magnetic properties are attained by providing secondary recrystallized structure with a texture having {110} face in parallel to a rolling face and <001> axis along a rolling direction or having so-called Goss orientation as a main direction.

For this purpose, various components including silicon are added to the grain-oriented magnetic silicon steel sheet. However, it is known that the workability lowers and particularly surface cracks and surface defects are apt to be considerably produced through hot rolling. If the degree of the surface defects is conspicuous, not only the appearance is poor, but also the degradation of the properties such as lowering of lamination factor, lowering of interlaminar insulation property and the like is caused. Therefore, it is an important matter how to prevent such surface cracks and surface defects in view of the production step.

As a method of decreasing cracks at the hot rolling step for the grain-oriented silicon steel sheet, there have hitherto been proposed a method of controlling intergranular oxidation by the addition of Mo or the like as described in JP-A-61-9521, a method of decreasing cracks by refining the structure through recrystallization as described in JP-A-2-182832, JP-A-3-115526 and JP-A-62-149815, and the like. However, these methods are not involved in drastic settlements.

Furthermore, JP-A-63-295044 proposes a method of controlling generation of slag by setting an existing time in a high-temperature furnace during the heating of slab to a certain upper limit, which brings about the restriction of operation to lower the productivity.

As mentioned above, the conventional techniques for preventing cracks of silicon steel sheet in the hot rolling do not yet provide satisfactory results.

DISCLOSURE OF INVENTION

It is an object of the invention to provide a method capable of producing silicon steel hot rolled sheets having good surface properties while effectively preventing generation of surface cracks from a new viewpoint that stress condition in the rolling deformation is improved to prevent generation of surface cracks by controlling a temperature distribution in the thickness direction.

The inventors have detailedly investigated a relationship between a temperature distribution in the thickness direction of a steel sheet and a state of surface cracks generated every a stand in rough and finish rolling at hot rolling step and found that the temperature distribution in the thickness direction of the steel sheet at the first stand of rough rolling and/or finish rolling has particularly a specific relation to the generating frequency of surface cracks and the temperature distribution in the thickness direction of the steel sheet is rendered into a particular range in accordance with thicknesses at entrance and delivery sides of said stands, and as a result the invention has been accomplished.

The feature and construction of the invention are as follows.

A method of producing silicon steel hot rolled sheets having excellent surface properties by subjecting a slab of silicon steel containing Si: 2.0–4.5 wt % to a rough hot rolling and then subjecting to a finish hot rolling is characterized in that rolling at the first stand of the rough hot rolling is carried out so that a relation of thickness at entrance side of the stand $t_{R1}$ (mm), thickness at delivery side thereof $t_{R2}$ (mm), surface temperature of the steel sheet at gripping $T_{R0}$ (° C.) and temperature at the depth of $(t_{R1}-t_{R2})/2$ (mm) from the surface of the steel sheet at gripping $T_{R1}$ satisfies the following equation (first invention):

$$(T_{R1}-T_{R0})/\{(t_{R1}-t_{R2})/2\} \leqq 10 \text{ (° C./mm)}$$

A method of producing silicon steel hot rolled sheets having excellent surface properties by subjecting a slab of silicon steel containing Si: 2.0–4.5 wt % to a rough hot rolling and then subjecting to a finish hot rolling is characterized in that rolling at the first stand in the finish hot rolling is carried out so that a relation of thickness at entrance side of the stand $t_{F1}$ (mm), thickness at delivery side thereof $t_{F2}$ (mm), surface temperature of the steel sheet at gripping $T_{F0}$ (° C.) and temperature at a depth of $(t_{F1}-t_{F2})/2$ (mm) from the surface of the steel sheet at gripping $T_{F1}$ satisfies the following equation (second invention):

$$(T_{F1}-T_{F0})/(t_{F1}-t_{F2})/2 \leqq 10+t_{F1}/10 \text{ (° C./mm)}$$

A method of producing silicon steel hot rolled sheets having excellent surface properties by subjecting a slab of silicon steel containing Si: 2.0–4.5 wt % to a rough hot rolling and then subjecting to a finish hot rolling is characterized in that rolling at the first stand in the rough hot rolling is carried out so that a relation of thickness at entrance side of the stand $t_{R1}$ (mm), thickness at delivery side thereof $t_{R2}$ (mm), surface temperature of the steel sheet at gripping $T_{R0}$ (° C.) and temperature at a depth of $(t_{R1}-t_{R2})/2$ (mm) from the surface of the steel sheet at gripping $T_{R1}$ satisfies the following equation:

$$(T_{R1}-T_{R0})/\{(t_{R1}-t_{R2})/2\} \leqq 10 \text{ (° C./mm)}$$

and rolling at the first stand in the finish hot rolling is carried out so that a relation of thickness at entrance side of the stand $t_{F1}$ (mm), thickness at delivery side thereof $t_{F2}$ (mm), surface temperature of the steel sheet at gripping $T_{F0}$ (° C.) and temperature at a depth of $(t_{F1}-t_{F2})/2$ (mm) from the surface of the steel sheet at gripping $T_{F1}$ satisfies the following equation (third invention):

$$(T_{F1}-T_{F0})/(t_{F1}-t_{F2})/2 \leqq 10+t_{F1}/10 \text{ (° C./mm)}$$

In case of controlling the temperature distribution in the thickness direction of the steel sheet at the first stand of the finish hot rolling as in the second or third invention, it is desired to avoid the lowering of the surface temperature of the steel sheet as far as possible. For this purpose, it is favorable that the steel sheet is subjected to the finish hot rolling without substantially conducting water cooling after the rough hot rolling.

From the same reason as mentioned above, it is favorable that descaling conducted between the rough hot rolling and the finish hot rolling in the second or third invention is carried out by water jetting at the pressure of not more than 15 kgf/cm$^2$, or by steam spraying, gas spraying or mechanical means.

Furthermore, it is desirable to conduct a heat holding treatment between the rough hot rolling and the finish hot rolling in the second or third invention.

As to the method of defining the temperature distribution in the thickness direction, JP-B-4-124218 proposes a method wherein temperature ranging from the surface of the sheet to the depth corresponding to ⅕ of the thickness is defined to 1200°–1250° C. at the final stand of the rough rolling to provide excellent magnetic properties. This method is to improve the magnetic properties by the improvement of texture, which can not expect the improving effect on the surface cracks aimed at the invention.

Furthermore, in Japanese Patent Application No. 3-163391 filed by the applicants, there is proposed a method wherein the rough rolling is first carried out at not lower than 1350° C. in the region ranging from a center of the sheet to a position corresponding to ⅖ of the thickness and a final rolling pass thereof is carried out so that the temperature in the region ranging from the center of the sheet to the position corresponding to ⅖ of the thickness is not lower than 1250° C. and the temperature in the region ranging from the surface to a position corresponding to ⅕ of the thickness is 1200° C. This method is to control the precipitation of inhibitors at the layer of a specified thickness and has no effect on the prevention of the cracks.

Moreover, JP-A-2-138418 defines the temperature distribution in the thickness direction at the heating of the slab, which is to promote the solution of inhibitors at the region of a specified depth and does not develop the effect of controlling the cracks as aimed at the invention at all.

The cause of the surface cracks and surface defects in the hot rolling to be solved by the invention is considered to be based on the following theory from experimental results in a rolling testing machine and analytical results of the stress distribution.

That is, when the temperature gradient in the thickness direction in the vicinity of the surface of the steel sheet is small at gripping to each stand of the rough hot rolling or the finish hot rolling, the sheet is subjected to compression stress in both the thickness direction and the rolling direction to cause deformation. On the other hand, when the cooling at the surface is large and the temperature gradient is large, the deformation is caused by subjecting to compression stress in the thickness direction and subjecting to tensile stress in the rolling direction, which results in generating cracks.

The mechanism of generating cracks is due to a mechanism entirely different from the conventionally known intergranular embrittlement near melting point.

In the rough hot rolling, cracks are remarkably produced at the first stand in which the surface temperature is highest and the texture is weak. On the other hand, the temperature distribution in the thickness direction is equalized through the rolling on and after the second stand, so that the generating ratio of the cracks lowers. Therefore, it has been found that the control of the temperature distribution in the thickness direction of the steel sheet at the first stand in the rough hot rolling is most important.

Then, the same fact as in the rough hot rolling is considered even in the finish hot rolling. In the finish hot rolling, the generating ratio of the above cracks particularly increases when the gripping temperature at the first stand is within a range of 800°–1000° C. Although the reason is not clear, it is considered that the inhibitors precipitate into the intergranular phase at the above temperature range to lower the intergranular strength and hence promote the occurrence of intergranular cracks, while the precipitation of the inhibitors is not conspicuous at the temperature outside the above temperature range and the degree of causing cracks decreases. The cracks in such a finish hot rolling are closely related to the temperature distribution in the thickness direction of the steel sheet at the entrance side of the first stand, while on and after the second stand, the equalization of temperature in the thickness direction is promoted and the recrystallization of the texture is caused to lower the susceptibility to the cracks. Therefore, the control of the temperature distribution in the thickness direction of the steel sheet at the entrance side of the first finish stand according to the invention is very important in the prevention of the cracks.

Concrete methods of decreasing the temperature gradient from the surface toward the thickness direction according to the invention are means by reducing or rendering water flow for cooling or scale removal before the first rough rolling stand and/or the first finish rolling stand into substantially 0, means by reducing heat dissipation due to radiation, means by increasing time up to the rolling after the cooling to recuperate heat, and means by heating from exterior alone or in combination thereof.

In case of silicon steel, it is frequent to conduct the water cooling between the rough hot rolling and the finish hot rolling for objects other than descaling. Because, when the finish rolling is carried out at an excessively high temperature, the coarse precipitation of inhibitors and the degradation of texture occur, which are unfavorable in the magnetic properties. For this end, the water cooling may be carried out by arranging a water cooling device before the finish rolling, but there is a fear that the temperature of the sheet bar surface is lowered by the water cooling to exceed the temperature gradient from the surface toward the thickness direction over the range defined in the invention. In order to avoid such a fear, the sheet bar is subjected to the finish hot rolling without substantially conducting the water cooling after the rough hot rolling, while the cooling may be strengthened between the stands in the finish hot rolling to control the temperature to a desired value.

Furthermore, since the formation of scale containing silicon is particularly conspicuous in the silicon steel, new scale is produced even between the rough hot rolling and the finish hot rolling. Therefore, in order to prevent the defect resulted from the gripping of the scale in the finish hot rolling, it is important to conduct the descaling between the rough hot rolling and the finish hot rolling. As the descaling method, jetting high-pressure water is conventionally known. In this method, however, a trouble of lowering the temperature of the sheet bar surface becomes conspicuous. Therefore, when it is difficult to satisfy the condition expected in the invention, the object of the invention can be attained by decreasing the pressure of the water flow. When the pressure of water exceeds 15 kgf/cm$^2$, the cooling effect becomes rapidly large, so that the water pressure is desirable to be not more than 15 kgf/cm$^2$.

In order to prevent the decrease of the surface temperature of the steel sheet, even if the descaling is carried out by steam, high-pressure gas, compressed air or the like without conducting the water jetting descaling, it is possible to effectively conduct the descaling without the decrease of the surface temperature. Furthermore, these descaling methods can eliminate water dropwise added onto the sheet bar from a surrounding equipment or the like to reduce the influence of water even when the jetting is carried out in a small amount being a small descaling effect, whereby the decrease of the surface temperature can be prevented. Moreover, the similar effect is obtained by mechanically carrying out the descaling with brush or the like.

As a more effective method for preventing the decrease of the surface temperature of the steel sheet, there is a method wherein a heat holding treatment is carried out after the rough hot rolling and before the finish hot rolling. For example, the decrease of the surface temperature due to radiation can be prevented by arranging a heat holding equipment, which is made from stainless steel plate lined with a heat insulating material so as to cover the sheet bar, between rough rolling mill and finish rolling mill and passing the rough rolled sheet bar through the heat holding equipment to the finish rolling step. This effect becomes large when the heat holding treatment is conducted just before the finish rolling and the equipment is arranged over a long distance.

The most effective method is a method wherein the steel sheet is heated by induction heating, electrical radiation heating or the like to increase the surface temperature of the steel sheet. This method becomes somewhat high in the equipment cost but provides a very stable effect.

Moreover, the aforementioned various means may be used alone or in a combination thereof.

The slab of silicon steel used as a starting material in the invention contains Si: 2.0–4.5 wt %. When the Si amount is less than 2.0 wt %, the electric resistance is low, and the iron loss based on the increase of eddy current becomes large, and the effect of decreasing cracks according to the invention is not clearly recognized. While, when it exceeds 4.5 wt %, brittle cracks are apt to be caused. Therefore, it is within a range of 2.0–4.5 wt %.

The other components are not particularly restricted, but a typical component composition as a hot rolled sheet for grain-oriented magnetic steel sheet is mentioned as follows.

The composition contains C: 0.01–0.1 wt %, Si: 2.0–4.5 wt % and Mn: 0.03–0.1 wt % and contains 0.01–0.1 wt % in total of one or two of S and Se when Mns or MnSe is used as inhibitor, or Al: 0.01–0.06 wt % and N: 0.003–0.01 wt % when AlN is used as inhibitor. Moreover, MnS, MnSe and AlN may be used in admixture.

As the inhibitor, Cu, Sn, Cr, Ge, Sb, Mo, Te, Bi, P and the like are advantageously adaptable in addition to the above S, Se and Al, so that they may be included in a small amount thereof.

In the first and third inventions, it is important that the rolling at the first stand in the rough hot rolling is carried out under a condition that a relation of thickness at entrance side of the stand $t_{R1}$ (mm), thickness at delivery side thereof $t_{R2}$ (mm), surface temperature of the steel sheet at gripping $T_{R0}$ (° C.) and temperature at a depth of $(t_{R1}-t_{R2})/2$ (mm) from the surface of the steel sheet at gripping $T_{R1}$ satisfies the following equation:

$$(T_{R1}-T_{R0})/\{(t_{R1}-t_{R2})/2\} \leqq 10 \text{ (° C./mm).}$$

There will be described an experiment for elucidating such a condition below.

A slab of silicon steel containing C: 0.03–0.08 wt %, Si: 2.0–4.5 wt %, Mn: 0.03–0.08 wt % and Se: 0.01–0.05 wt % and the balance being substantially Fe and having a thickness of 160–250 mm is heated at 1420° C. for 20 minutes and subjected to a rough rolling by varying cooling condition.

After one pass of the rough rolling, a ratio of cracks generated per unit area in an observed surface of the steel sheet (1 $m^2$) is measured and shown in FIG. 1 as a relation to the value of the equation $(T_{R1}-T_{R0})/\{(t_{R1}-t_{R2})/2\}$ calculated from the measured results of surface temperature $T_{R0}$ and temperature $T_{R1}$ at the depth of $(t_{R2}-t_{R1})/2$ at gripping when the thickness at entrance side of the first stand in rough rolling is $t_{R1}$ (mm) and the thickness at delivery side of the first stand in rough rolling is $t_{R2}$ (mm). Moreover, this equation means a temperature gradient in the vicinity of the surface of the steel sheet in the thickness direction thereof.

As seen from FIG. 1, when $(T_{R1}-T_{R0})/\{(t_{R1}-t_{R2})/2\}$ exceeds 10, the occurrence of cracks becomes conspicuous. Therefore, according to the invention, the rolling at the first rough rolling stand is carried out under the condition satisfying $(T_{R1}-T_{R0})/\{(t_{R1}-t_{R2})/2\} \leqq 10$ (° C./mm).

In the second and third inventions, it is important that the rolling at the first stand in the finish hot rolling is carried out under a condition that a relation of thickness at entrance side of the stand $t_{F1}$ (mm), thickness at delivery side thereof $t_{F2}$ (mm), surface temperature of the steel sheet at gripping $T_{F0}$ (° C.) and temperature at the depth of $(t_{F1}-t_{F2})/2$ (mm) from the surface of the steel sheet at gripping $T_{F1}$ satisfies the following equation:

$$(T_{F1}-T_{F0})/\{(t_{F1}-t_{F2})/2\} \leqq 10+t_{F1}/10 \text{ (° C./mm).}$$

There will be described an experiment for elucidating such a condition below.

A slab of silicon steel containing C: 0.03 wt %, Si: 2.8 wt %, Mn: 0,065 wt % and Se: 0.022 wt % and the balance being substantially Fe and having a thickness of 200 mm is heated at 1420° C. for 20 minutes, subjected to a rough rolling to a thickness of 20 mm, 40 mm or 60 mm, and then subjected to a finish rolling by varying cooling condition to change temperature gradient variously in the vicinity of the surface of the steel sheet in the thickness direction thereof.

After one pass of the finish rolling, a ratio of cracks generated per unit area in an observed surface of the steel sheet (100 $cm^2$) is measured and shown in FIG. 2 as a relation to the value of the equation $(T_{F1}-T_{F0})/\{(t_{F1}-t_{F2})/2\}$ calculated from the measured results of surface temperature $T_{F0}$ (° C.) and temperature $T_{F1}$ at the depth of $(t_{F1}-t_{F2})/2$ (mm) at gripping when the thickness at entrance side of the first stand in the finish rolling is $t_{F1}$ (mm) and the thickness at delivery side thereof is $t_{F2}$ (mm). Moreover, FIG. 2*a* shows a case that the thickness at entrance side is 20 mm, FIG. 2*b* shows a case that the thickness at the entrance side is 40 mm and FIG. 2*c* shows a case that the thickness at entrance side is 60 mm.

Next, a slab of silicon steel containing C: 0,056 wt %, Si: 3.24 wt %, Mn: 0.13 wt %, Al: 0,027 wt %, N: 0,008 wt % and S: 0,007 wt % and the balance being substantially Fe and having a thickness of 240 mm is heated at 1300° C. for 30 minutes, subjected to a rough rolling to the thickness of 20 mm, 40 mm or 60 mm, and then subjected to a finish rolling by varying cooling condition to change temperature gradient variously in the vicinity of the surface of the steel sheet in the thickness direction thereof.

After one pass of the finish rolling, a ratio of cracks generated per unit area in an observed surface of the steel sheet (100 $cm^2$) is measured and shown in FIG. 3 as the relation to the value of the equation $(T_{F1}-T_{F0})/\{(t_{F1}-t_{F2})/2\}$ calculated from the measured results of surface temperature $T_{F0}$ (° C.) and temperature $T_{F1}$ at the depth of $(t_{F1}-t_{F2})/2$ (mm) at gripping when the thickness at entrance side of the first stand in finish rolling is $t_{F1}$ (mm) and the thickness at delivery side thereof is $t_{F2}$ (mm). Moreover, FIG. 3*a* shows a case that the thickness at entrance side is 20 mm, FIG. 3*b* shows a case that the thickness at entrance side is 40 mm and FIG. 3*c* shows a case that the thickness at entrance side is 60 mm.

The experimental results shown in FIGS. 2 and 3 are summarized in FIG. 4 as a relationship between the thickness at entrance side $t_1$ and $(T_{F1}-T_{F0})/\{(t_{F1}-t_{F2})/2\}$. AS seen from FIG. 4, the region generating cracks is dependent upon the thickness at entrance side, so that the cracks can be prevented within a range satisfying the following equation:

$$(T_{F1}-T_{F0})/\{(t_{F1}-t_{F2})/2\} \leqq 10+t_{F1}/10 \text{ (° C./mm).}$$

According to the invention, therefore, the rolling at the first stand of the finish rolling is carried out so as to satisfy the above equation.

In the actual production steps, it is not easy to measure the interior temperature of the slab or sheet bar. However, the interior temperature can be evaluated by a method detailedly described in ISIJ International. vol. 31(1991) No. 6, pp571–576, whereby the temperature control according to the invention can be conducted. Moreover, the surface and interior temperatures in the invention may be selected from typical points on upper and lower surfaces and in widthwise and longitudinal directions, but it is generally desirable to use a temperature at a widthwise central portion of the upper surface more causing the cooling.

BRIEF DESCRIPTION OF DRAWINGS

FIG. 2 is a graph showing a relation between the temperature gradient in the thickness direction of the material and the ratio of cracks generated at gripping at the first stand of finish hot rolling, in which

FIG. 3 is a graph showing a relation between the temperature gradient in the thickness direction of the material and/the ratio of cracks generated at gripping at the first stand of finish hot rolling, in which

BEST MODE FOR CARRYING OUT THE INVENTION

Example 1

Figure 1:
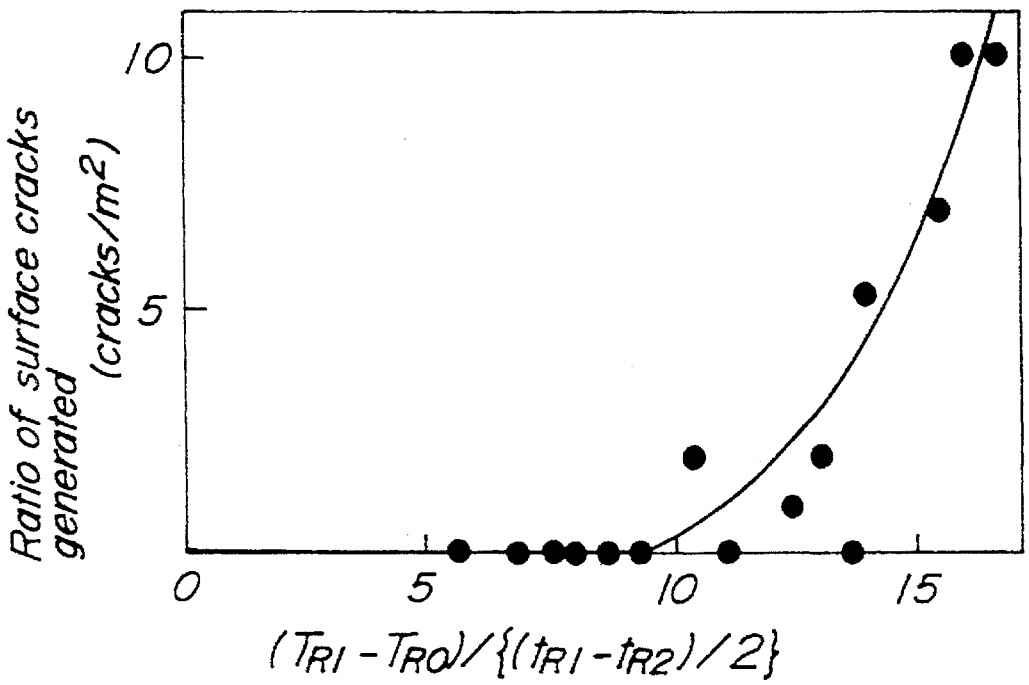
FIG. 1 is a graph showing a relation between the temperature gradient in the thickness direction of the material and the ratio of cracks generated at gripping at the first stan of rough hot rolling.
Figure 2A:
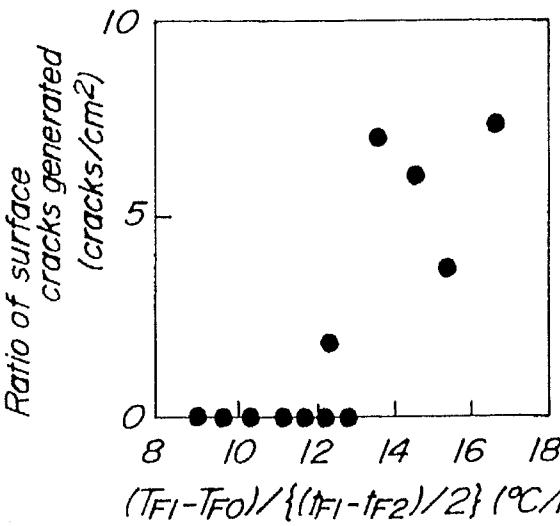
FIG. 2*a* shows a case at the thickness entrance side is 20 mm.
Figure 2B:
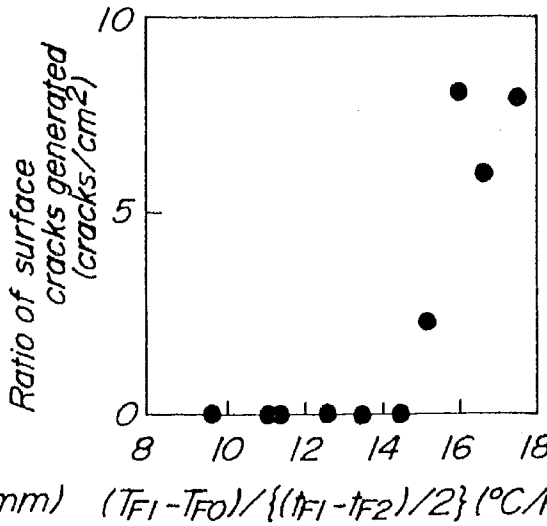
FIG. 2*b* shows a case that thickness at entrance side is 40 mm and FIG. 2*c* shows a case that the thickness at entrance side is 60 mm.
Figure 2C:
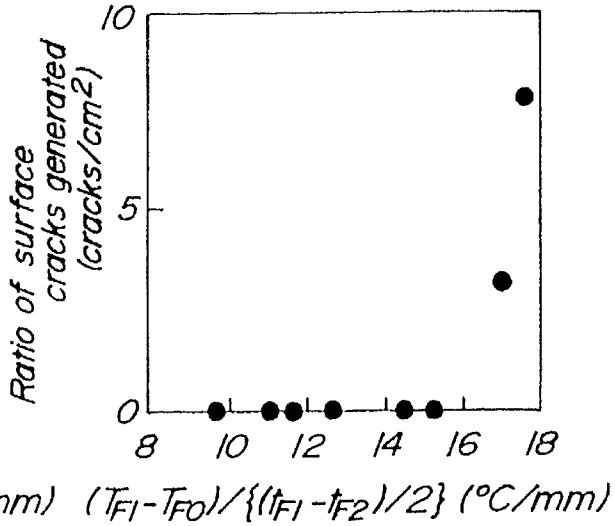
Figure 3A:
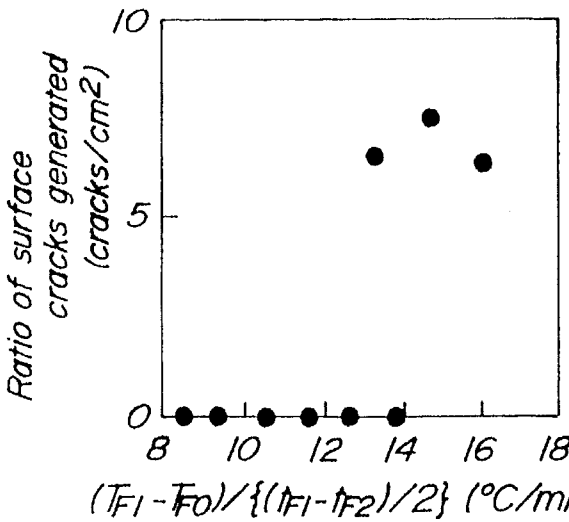
FIG. 3*a* shows a case that the thicknesses at entrance side is 20 mm.
Figure 3B:
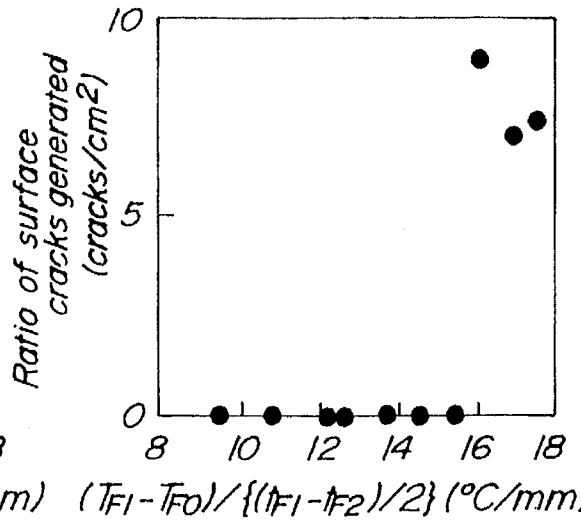
FIG. 3*b* shows a case that thickness at entrance side is 40 mm and FIG. 3*c* shows a case that the thickness at entrance side is 60 mm.
Figure 3C:
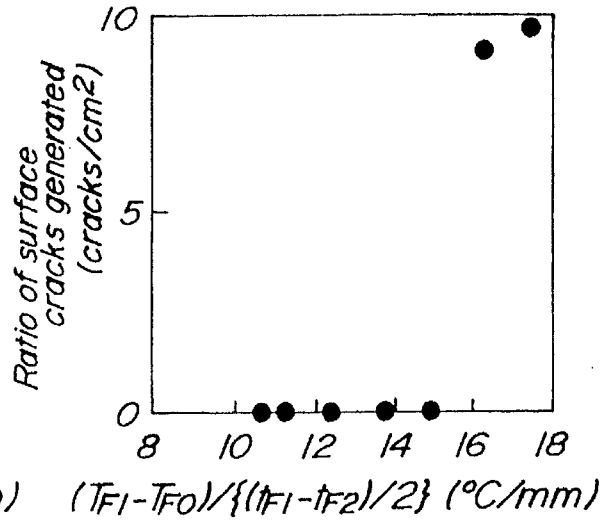
Figure 4:
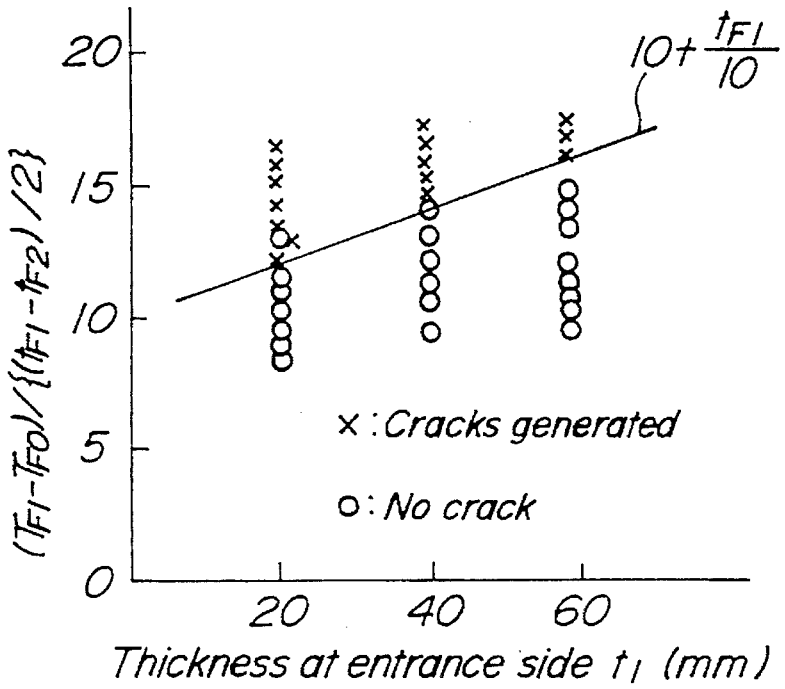
FIG. 4 is a graph showing the results of FIGS. 2 and 3 as a relation between initial thickness and the limit of genera racks.

This example shows a case of conducting temperature distribution control at the first stand of rough rolling.

A slab of silicon steel containing C: 0.03 wt %, Si: 2.8 wt %, Mn: 0.065 wt % and Se: 0.022 wt % and the remainder being substantially Fe and having a thickness of 200 mm is heated at 1420° C. for 20 minutes, rolled to a thickness range of from 140 mm to 180 mm at the first stand of rough rolling by varying temperature distribution in the thickness direction of the steel sheet under various water cooling and air cooling conditions and then rolled to a thickness of 50 mm at remaining stands of rough rolling, which is subjected to a finish hot rolling of 7 stands to obtain a hot rolled sheet having a thickness of 2.0 mm.

The results of cracks observed after the rolling at the first stand of rough rolling are shown in Table 1 together with temperature conditions of the steel sheet at this stand.

TABLE 1

| | $T_{R0}$ (°C.) | $T_{R1}$ (°C.) | $t_{R1}$ (mm) | $t_{R2}$ (mm) | $\frac{(T_{R1}-T_{R0})}{(t_{R1}-t_{R2})/2}$ | Number of cracks generated (cracks/m²) | Classification |
|---|---|---|---|---|---|---|---|
| 1 | 1190 | 1370 | 200 | 140 | 6 | 0 | Acceptable Example |
| 2 | 1240 | 1380 | 200 | 160 | 7 | 0 | Acceptable Example |
| 3 | 1260 | 1360 | 200 | 180 | 10 | 0 | Acceptable Example |
| 4 | 1020 | 1360 | 200 | 140 | 17 | 2 | Comparative Example |
| 5 | 1100 | 1340 | 200 | 160 | 12 | 7 | Comparative Example |

Example 2

This example shows a case of conducting temperature distribution control at the first stand of rough rolling.

A slab of silicon steel containing C: 0.08 wt %, Si: 3.3 wt %, Mn: 0.074 wt % and Se: 0.021 wt % and the remainder being substantially Fe and having a thickness of 240 mm is heated at 1420° C. for 30 minutes, rolled to a thickness range of from 140 mm to 200 mm at the first stand of rough rolling by varying temperature distribution in the thickness direction of the steel sheet under various water cooling and air cooling conditions and then rolled to a thickness of 30 mm at remaining 3 stands of rough rolling, which is subjected to a finish hot rolling of 7 stands to obtain a hot rolled sheet having a thickness of 2.6 mm.

The results of cracks observed after the rolling at the first stand of rough rolling are shown in Table 2 together with temperature conditions of the steel sheet at this stand.

TABLE 2

| | $T_{R0}$ (°C.) | $T_{R1}$ (°C.) | $t_{R1}$ (mm) | $t_{R2}$ (mm) | $\frac{(T_{R1}-T_{R0})}{(t_{R1}-t_{R2})/2}$ | Number of cracks generated (cracks/m$^2$) | Classification |
|---|---|---|---|---|---|---|---|
| 1 | 1210 | 1410 | 240 | 140 | 4 | 0 | Acceptable Example |
| 2 | 1030 | 1330 | 240 | 170 | 8.6 | 0 | Acceptable Example |
| 3 | 1230 | 1330 | 240 | 200 | 5 | 0 | Acceptable Example |
| 4 | 960 | 1340 | 240 | 170 | 10.9 | 1 | Comparative Example |
| 5 | 1130 | 1370 | 240 | 200 | 12 | 4 | Comparative Example |

Example 3

This example shows a case of conducting temperature distribution control at the first stand of finish rolling.

A slab of silicon steel containing C: 0.04 wt %, Si: 3.1 wt %, Mn: 0,054 wt % and Se: 0,022 wt % and the remainder being substantially Fe and having a thickness of 200 mm is heated at 1420° C. for 20 minutes, rolled to a thickness of 50 mm at 3 stands of rough rolling and then subjected to water spraying (water pressure: 5 kgf/cm$^2$) to control a surface temperature of steel sheet to 940° C. and a temperature at the depth of 11 mm from the surface corresponding to $(t_{F1}-t_{F2})/2$ ($t_{F1}$: thickness at entrance side at the first stand, $t_{F2}$: thickness at delivery side at the first stand) to 1050° C., which is gripped at the first stand and subjected to finish rolling of 6 stands in total to obtain a hot rolled sheet having a final thickness of 2.0 mm. In this case, the thickness at delivery side of the first stand is 28 mm. After the rolling, the observation of surface cracks is conducted, and hence no crack is observed.

Example 4

This example shows a case of conducting temperature distribution control at the first stand of finish rolling.

A slab of silicon steel containing C: 0.07 wt %, Si: 3.1 wt %, Mn: 0,062 wt % and Se: 0,022 wt % and the remainder being substantially Fe and having a thickness of 200 mm is heated at 1400° C. for 20 minutes, rolled to a thickness of 35 mm at rough rolling of 4 stands and then subjected to water spraying (water pressure: 10 kgf/cm$^2$) to control a surface temperature of the steel sheet to 1030° C. and a temperature at the depth of 8 mm from the surface corresponding to $(t_{F1}-t_{F2})/2$ ($t_{F1}$: thickness at entrance side at the first stand, $t_{F2}$: thickness at delivery side at the first stand) to 1100° C., which is gripped at the first stand and subjected to finish rolling of 6 stands in total to obtain a hot rolled sheet having a final thickness of 2.6 mm. In this case, the thickness at delivery side of the first stand is 19 mm. After the rolling, the observation of surface cracks is conducted, and hence no crack is observed.

As a comparative example, a slab of silicon steel containing C: 0.07 wt %, Si: 3.1 wt %, Mn: 0.062 wt % and Se: 0.022 wt % and the remainder being substantially Fe and having a thickness of 200 mm is heated at 1400° C. for 20 minutes, rolled to a thickness of 30 mm at rough rolling of 4 stands and then subjected to a high-pressure water spraying (water pressure: 50 kgf/cm$^2$) to control a surface temperature of steel sheet to 850° C. and a temperature at the depth of 8 mm from the surface corresponding to $(t_{F1}-t_{F2})/2$ ($t_{F1}$: thickness at entrance side at the first stand, $t_{F2}$: thickness at delivery side at the first stand) to 970° C., which is gripped at the first stand and subjected to finish rolling of 6 stands in total to obtain a hot rolled sheet having a final thickness of 2.0 mm. In this case, the thickness at delivery side of the first stand is 14 mm. After the rolling, the observation of surface cracks is conducted, and hence the ratio of cracks generated is 7.2 cracks/cm$^2$.

Figure 5:
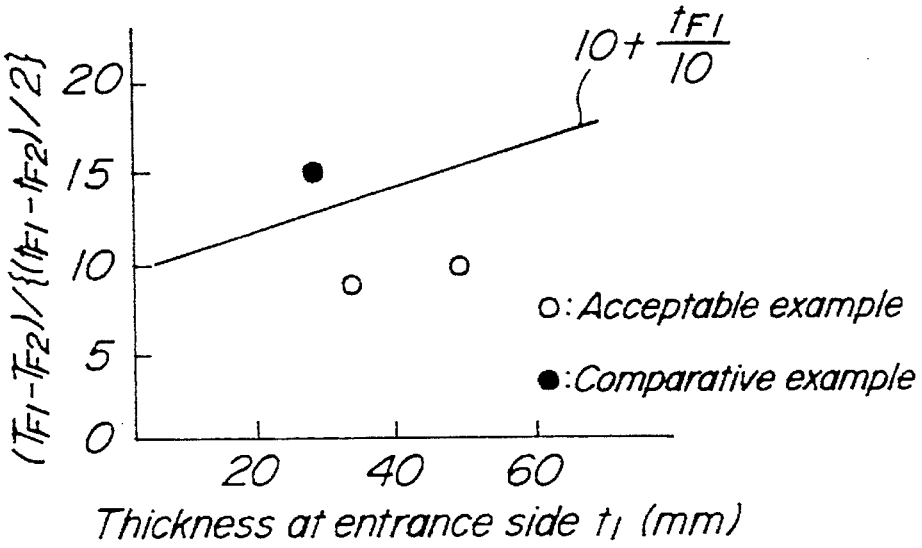
FIG. 5 is a graph showing surface state as the cracks in Example conducting temperature distribution control at the first stand of finish rolling as a relation to initial thickness.

The results of the above Examples 3 and 4 and comparative example are shown in FIG. 5 as a relation between thickness at entrance side $t_1$ and $(T_{R1}-T_{R0})/\{(t_{R1}-t_{R2})/2\}$.

Example 5

This example shows a case that finish rolling is conducted without water cooling after the rough hot rolling.

A slab of silicon steel containing C: 0.06 wt %, Si: 3.20 wt %, Mn: 0.05 wt % and Se: 0.015 wt % and the remainder being substantially Fe and having a thickness of 200 mm is heated at 1380° C. for 20 minutes and subjected to rough rolling of 5 stands to a thickness of 40 mm.

Then, the steel sheet is gripped into the first stand of finish rolling installation without being subjected to water cooling. In the gripping at the first stand, the surface temperature is 1100° C., and the temperature at the depth of 10 mm from the surface corresponding to $(t_{F1}-t_{F2})/2$ ($t_{F1}$: thickness at entrance side of the first stand, $t_{F2}$: thickness at delivery side of the first stand) is 1185° C. Such a finish rolling of 7 stands in total is carried out, in which the cooling between the stands is conducted by water cooling of 50 kgf/cm$^2$ which is higher than the usual one, to obtain a hot rolled sheet having a final thickness of 2.4 mm. In this case, the thickness at delivery side of the first stand is 20 mm. After the rolling, the observation of surface cracks is conducted, and hence no crack is observed.

Example 6

This example shows a case that descaling through steam spraying is conducted between rough hot rolling and finish rolling.

A slab of silicon steel containing C: 0.07 wt %, Si: 2.95 wt %, Mn: 0.06 wt %, S: 0.02 wt %, Al: 0.024 wt % and N: 0.008 wt % and the remainder being substantially Fe and having a thickness of 220 mm is heated at 1410° C. for 45 minutes and subjected to rough rolling of 3 stands to a thickness of 60 mm. Then. the steel sheet is subjected to steam spraying (180° C., spraying pressure: 9 kgf/cm$^2$) to conduct the descaling and to control the surface temperature to 960° C. and the temperature at the depth of 13 mm from the surface corresponding to $(t_{F1}-t_{F2})/2$ ($t_{F1}$: thickness at entrance side of the first stand, $t_{F2}$: thickness at delivery side of the first stand) to 1150° C., which is gripped into the first stand and subjected to finish rolling of 6 stands in total to obtain a hot rolled sheet having a final thickness of 2.8 mm. In this case, the thickness at delivery side of the first stand is 34 mm. After the rolling, the observation of surface cracks is conducted, and hence no crack is observed.

Example 7

This example shows a case that descaling through gas spraying is conducted between rough hot rolling and finish rolling.

A slab of silicon steel containing C: 0.07 wt %, Si: 2.95 wt %, Mn: 0.06 wt %, S: 0.02 wt %, Al: 0.024 wt % and N: 0,008 wt % and the remainder being substantially Fe and having a thickness of 220 mm is heated at 1410° C. for 45 minutes and subjected to rough rolling of 3 stands to a thickness of 60 mm in the same manner as in Example 6. Then, the steel sheet is subjected to gas spraying ($N_2$ gas, 30° C., spraying pressure: 9 kgf/cm$^2$) to conduct the descaling and to control the surface temperature to 1010° C. and the temperature at the depth of 13 mm from the surface corresponding to $(t_{F1}-t_{F2})/2$ ($t_{F1}$: thickness at entrance side of the first stand, $t_{F2}$: thickness at delivery side of the first stand) to 1150° C., which is gripped into the first stand and subjected to finish rolling of 6 stands in total to obtain a hot rolled sheet having a final thickness of 2.8 mm in the same manner as in Example 6. In this case, the thickness at delivery side of the first stand is 34 mm. After the rolling, the observation of surface cracks is conducted, and hence no crack is observed.

Example 8

This example shows a case that descaling through mechanical means is conducted between rough hot rolling and finish rolling.

A slab of silicon steel containing C: 0.07 wt %, Si: 2.95 wt %, Mn: 0.06 wt %, S: 0.02 wt %, Al: 0.024 wt % and N: 0,008 wt % and the remainder being substantially Fe and having a thickness of 220 mm is heated at 1410° C. for 45 minutes and subjected to rough rolling of 3 stands to a thickness of 60 mm in the same manner as in Example 6. Then, the steel sheet is subjected to brushing to conduct the descaling and then gripped into the first stand of finish rolling in which the surface temperature is 1030° C. and the temperature at the depth of 13 mm from the surface corresponding to $(t_{F1}-t_{F2})/2$($t_{F1}$: thickness at entrance side of the first stand, $t_{F2}$: thickness at delivery side of the first stand) is 1160° C. Thereafter, the sheet is subjected to finish rolling of 6 stands in total to obtain a hot rolled sheet having a final thickness of 2.8 mm in the same manner as in Example 6. In this case, the thickness at delivery side of the first stand is 34 mm. After the rolling, the observation of surface cracks is conducted, and hence no crack is observed.

Example 9

This example shows a case that heat-holding treatment is conducted between rough hot rolling and finish rolling.

A slab of silicon steel containing C: 0.03 wt %, Si: 2.95 wt %, Mn: 0.06 wt % and Se: 0,015 wt % and the remainder being substantially Fe and having a thickness of 260 mm is heated at 1450° C. for 20 minutes and subjected to rough rolling of 5 stands to a thickness of 30 mm. The temperature of the steel sheet after the rough rolling is 1250° C. at its surface.

Then, the steel sheet is passed through a heat holding equipment arranged between the rough hot rolling installation and the finish rolling installation. The heat-holding equipment has a rectangular shape surrounding the front and back surfaces of the steel sheet and both edge portions thereof and is comprised of a heat insulating material of porous alumina (thickness: 20 mm) lined with stainless steel (thickness: 0.8 mm). The length is 60 m. Moreover, the rear surface side is arranged so as to bury a gap of table rollers.

Subsequently, the steel sheet is gripped into the first stand of finish rolling, in which the surface temperature is 1190° C. and the temperature at the depth of 5 mm from the surface corresponding to $(t_{F1}-t_{F2})/2$ ($t_{F1}$: thickness at entrance side of the first stand, $t_{F2}$: thickness at delivery side of the first stand) is 1230° C. Such a finish rolling of 6 stands in total is carried out to obtain a hot rolled sheet having a final thickness of 2.8 mm. In this case, the thickness at delivery side of the first stand is 20 mm. After the rolling, the observation of surface cracks is conducted, and hence no crack is observed.

Example 10

This example shows a case that heat treatment is conducted between rough hot rolling and finish rolling.

A slab of silicon steel containing C: 0.02 wt %, Si: 3.35 wt %, Mn: 0.09 wt % and Se: 0.015 wt % and the remainder being substantially Fe and having a thickness of 200 mm is heated at 1440° C. for 20 minutes and subjected to rough rolling of 3 stands to a thickness of 40 mm. The temperature of the steel sheet after the rough rolling is 1170° C. at its surface.

Then, the steel sheet is subjected to a heat treatment between the rough hot rolling installation and the finish rolling installation. The heat treatment is carried out through radiant heating process and the heating condition is 15 kW/m2 for 30 seconds.

Subsequently, the steel sheet is gripped into the first stand of finish rolling, in which the surface temperature is 1140° C. and the temperature at the depth of 8 mm from the surface corresponding to $(t_{F1}-t_{F2})/2$ ($t_{F1}$: thickness at entrance side of the first stand, $t_{F2}$: thickness at delivery side of the first stand) is 1200° C. Such a finish rolling of 7 stands in total is carried out to obtain a hot rolled sheet having a final thickness of 2.2 mm. In this case, the thickness at delivery side of the first stand is 24 mm. After the rolling, the observation of surface cracks is conducted, and hence no crack is observed.

Example 11

This example shows a case of conducting temperature distribution control at the first stand of rough rolling and the first stand of finish rolling.

A slab of silicon steel containing C: 0.04 wt %, Si: 3.20 wt %, Mn: 0.06 wt % and Se: 0.022 wt % and the remainder being substantially Fe and having a thickness of 260 mm is heated at 1430° C. for 30 minutes, rolled to a thickness of 220 mm at the first stand of rough rolling by controlling a surface temperature of the steel sheet to 1340° C. and the temperature at the depth of 20 mm from the surface corresponding to $(t_{R1}-t_{R2})/2$ ($t_1$: thickness at entrance side of the first stand, $t_{R2}$: thickness at delivery side of the first stand) to 1410° C. and then subjected to rough rolling of remaining 3 stands to a thickness of 40 mm. Next, the steel sheet is subjected to water spraying (water pressure: 5 kgf/cm$^2$) to control a surface temperature to 980° C. and the temperature at the depth of 10 mm from the surface corresponding to $(t_{F1}-t_{F2})/2$ ($t_{F1}$: thickness at entrance side of the first stand, $t_{F2}$: thickness at delivery side of the first stand) to 1080° C., which is gripped into the first stand and subjected to a finish hot rolling of 7 stands to obtain a hot rolled sheet having a thickness of 2.6 mm. In this case, the thickness at delivery side of the first stand is 20 mm. After the rolling, the observation of surface cracks is conducted, and hence no crack is observed.

Example 12

This example shows a case of conducting temperature distribution control at the first stand of rough rolling and the first stand of finish rolling and conducting heat treatment between rough hot rolling and finish rolling.

A slab of silicon steel containing C: 0.04 wt %, Si: 3.20 wt %, Mn: 0.06 wt % and Se: 0.022 wt % and the remainder being substantially Fe and having a thickness of 260 mm is heated at 1430° C. for 30 minutes, rolled to a thickness of 220 mm at the first stand of rough rolling by controlling a surface temperature of the steel sheet to 1340° C. and the temperature at the depth of 20 mm from the surface corresponding to $(t_{R1}-t_{R2})/2$($t_{R1}$: thickness at entrance side of the first stand, $t_{R2}$: thickness at delivery side of the first stand) to 1410° C. and then subjected to rough rolling of remaining 3 stands to a thickness of 40 mm in the same manner as in Example 11

Next, the steel sheet is subjected to high-pressure water spraying (water pressure: 50 kgf/cm$^2$) to conduct descaling, in which the surface temperature is 860° C. and the temperature at the depth of 10 mm from the surface corresponding to $(t_{F1}-t_{F2})/2$ ($t_{F1}$: thickness at entrance side of the first stand, $t_{F2}$: thickness at delivery side of the first stand) is 1060° C. Then, the steel sheet is subjected to a heat treatment through radiant heating process under condition of 20 kW/m$^2$ for 7 seconds, in which the surface temperature is 900° C. and the temperature at the depth of 10 mm from the surface corresponding to $(t_{F1}-t_{F2})/2$ ($t_{F1}$: thickness at entrance side of the first stand, $t_{F2}$: thickness at delivery side of the first stand) is 1030° C. The steel sheet is gripped into the first stand of finish rolling installation and subjected to a finish rolling of 7 stands in total to obtain a hot rolled sheet having a thickness of 2.6 mm in the same manner as in Example 11o In this case, the thickness at delivery side of the first stand is 20 mm. After the rolling, the observation of surface cracks is conducted, and hence no crack is observed.

INDUSTRIAL APPLICABILITY

According to the invention, the temperature distribution in the vicinity of the steel sheet surface in the thickness direction thereof at the first stand of rough rolling and/or finish rolling is adjusted to be lowered in accordance with the thicknesses at entrance and delivery sides of such stands, whereby grain-oriented silicon steels having very excellent surface properties can be produced without bringing about poor appearance, low lamination factor and low interlaminar insulating pressure.

Furthermore, such an adjustment can easily be conducted by conducting no cooling between the rough hot rolling and the finish rolling, or by conducting heat-holding treatment or heat treatment.

Moreover, if there is caused a fear that the conditions defined in the invention are not satisfied in high-pressure water spraying for descaling in the adjustment, the descaling is conducted by low-pressure water spraying, steam spraying or gas spraying instead of the water spraying, or mechanical means, whereby the invention can surely be realized without causing the above inconveniences.

We claim:

1. A method of producing silicon steel hot rolled sheets having excellent surface properties by subjecting a slab of silicon steel containing Si: 2.0–4.5 wt % to a rough hot rolling through a first stand to form a steel sheet, having opposing surfaces, and then subjecting said steel sheet to a finish hot rolling, characterized in that rolling at said first stand in the rough hot rolling is carried out so that a relation of thickness at entrance side of said first stand $t_{R1}$ (mm), thickness at delivery side thereof $t_{R2}$ (mm), surface temperature of said steel sheet at gripping $T_{R0}$ (° C.) and temperature at the depth of $(t_{R1}-t_{R2})/2$ (mm) from at least one opposing surface of said steel sheet at gripping $T_{R1}$ satisfies the following equation:

$$(T_{R1}-T_{R0})/\{(t_{R1}-t_{R2})/2\}\leqq 10 \text{ (° C./mm)}.$$

2. A method of producing silicon steel hot rolled sheets having excellent surface properties by subjecting a slab of silicon steel containing Si: 2.0–4.5 wt % to a rough hot rolling to form a steel sheet having opposing surfaces, and then subjecting said steel sheet to a finish hot rolling through a first stand, characterized in that rolling at said first stand in said finish hot rolling is carried out so that a relation of thickness at entrance side of said first stand $t_{F1}$ (mm), thickness at delivery side thereof $t_{F2}$ (mm), surface temperature of said steel sheet at gripping $T_{F0}$ (° C.) and temperature at the depth of $(t_{F1}-t_{F2})/2$ (mm) from at least one opposing surface of said steel sheet at gripping $T_{F1}$ satisfies the following equation:

$$(T_{F1}-T_{F0})/\{(t_{F1}-t_{F2})/2\}\leqq 10+t_{F1}/10 \text{ (° C./mm)}.$$

3. A method of producing silicon steel hot rolled sheets having excellent surface properties by subjecting a slab of silicon steel containing Si: 2.0–4.5 wt % to a rough hot rolling through a first stand to form a steel sheet having opposing surfaces, and then subjecting to a finish hot rolling through a first stand, characterized in that rolling at the first stand in said rough hot rolling is carried out so that a relation of thickness at entrance side of said first rough hot rolling stand $t_{R1}$ (mm), thickness at delivery side thereof $t_{R2}$ (mm), surface temperature of said steel sheet at gripping $T_{R0}$ (° C.) and temperature at the depth of $(t_{R1}-t_{R2})/2$ (mm) from at least one opposing surface of said steel sheet at gripping $T_{R1}$ satisfies the following equation:

$$(T_{R1}-T_{R0})/\{(t_{R1}-t_{R2})/2\}\leqq 10 \text{ (° C./mm)}$$

and rolling at said first stand in the finish hot rolling is carried out so that a relation of thickness at entrance side of said first finish hot rolling stand $t_{F1}$ (mm), thickness at delivery side thereof $t_{F2}$ (mm), surface temperature of said steel sheet at gripping $T_{F0}$ (° C.) and temperature at the depth of $(t_{F1}-t_{F2})/2$ (mm) from at least one opposing surface of the steel sheet at gripping $T_{F1}$ satisfies the following equation:

$$(T_{F1}-T_{F0})/\{(t_{F1}-t_{F2})/2\}\leqq 10+t_{F1}/10 \text{ (° C./mm)}.$$

4. A method of producing silicon steel hot rolled sheets having excellent surface properties according to claim 2 or 3, wherein said steel sheet is subjected to the finish hot rolling without substantially conducting water cooling after the rough hot rolling.

5. A method of producing silicon steel hot rolled sheets having excellent surface properties according to claim 2 or 3, wherein descaling conducted between the rough hot rolling and the finish hot rolling is carried out by water jetting at the pressure of not more than 15 $kgf/cm^2$.

6. A method of producing silicon steel hot rolled sheets having excellent surface properties according to claim 2 or 3, wherein descaling conducted between the rough hot rolling and the finish hot rolling is carried out without water jetting.

7. A method of producing silicon steel hot rolled sheets having excellent surface properties according to claim 6, Wherein the descaling is conducted by steam spraying.

8. A method of producing silicon steel hot rolled sheets having excellent surface properties according to claim 6, wherein the descaling is conducted by gas spraying.

9. A method of producing silicon steel hot rolled sheets having excellent surface properties according to claim 6, wherein the descaling is conducted by mechanical means.

10. A method of producing silicon steel hot rolled sheets having excellent surface properties according to claim 2 or 3, wherein heat holding treatment is conducted between the rough hot rolling and the finish hot rolling.

11. A method of producing silicon steel hot rolled sheets having excellent surface properties according to claim 2 or 3, wherein heating treatment is conducted between the rough hot rolling and the finish hot rolling.

* * * * *

UNITED STATES PATENT AND TRADEMARK OFFICE

CERTIFICATE OF CORRECTION

PATENT NO. : 5,572,892

DATED : November 12, 1996

INVENTOR(S) : Mineo Muraki et al

It is certified that error appears in the above-indentified patent and that said Letters Patent is hereby corrected as shown below:

Column 6, line 47, please change "0,027" to --0.027-- and "0,008" to --0.008--; and
line 48, please change "0,007" to --0.007--.
Column 7, line 3, please change "AS" to --As--.
Column 8, line 23, after "remaining" please insert --4--.
Column 9, line 44, please change "0,062" to --0.062-- and "0,022" to --0.022--.
Column 11, line 17, please change "0,008" to --0.008--;
line 42, please change "0,008" to --0.008--; and
line 64, please change "0,015" to --0.015--.
Column 13, line 48, please change "11o" to --11.--.
Column 15, line 16, please change "Wherein" to --wherein--.

Signed and Sealed this

Twenty-eighth Day of January, 1997

*Attest:*

Bruce Lehman

BRUCE LEHMAN

*Attesting Officer* *Commissioner of Patents and Trademarks*